US005265294A

United States Patent [19]

McClure et al.

[11] Patent Number: 5,265,294

[45] Date of Patent: Nov. 30, 1993

[54] PVC MATTRESS WITH IMPERMEABLE PVC COATING

[76] Inventors: Betty J. McClure; Homer R. McClure, both of 13118 E. 71st St. N., Owasso, Okla. 74055

[21] Appl. No.: 974,993

[22] Filed: Nov. 12, 1992

[51] Int. Cl.[5] ..... A47C 27/14

[52] U.S. Cl. ..... 5/473; 5/481; 264/129; 427/393.5; 428/318.6; 428/319.7; 428/520

[58] Field of Search ..... 5/473, 420, 481, 448; 297/DIG. 1; 264/124, 128; 427/393.5; 428/318.6, 319.7, 520

[56] References Cited

U.S. PATENT DOCUMENTS

| | | | |
|---|---|---|---|
| 3,058,124 | 10/1962 | Sturtevant | 5/450 |
| 3,066,646 | 12/1962 | Bramley | 5/420 |
| 4,035,853 | 7/1977 | Platter . | |
| 4,138,753 | 2/1979 | Wood | 5/473 |
| 4,275,473 | 6/1981 | Poirier | 5/465 |
| 4,316,298 | 2/1982 | Russo et al. | 5/465 |
| 4,357,725 | 11/1982 | Ahlm | 5/468 |
| 4,825,487 | 5/1989 | Eberl | 5/464 |
| 5,007,123 | 4/1991 | Salyards | 5/448 |

FOREIGN PATENT DOCUMENTS

| | | | |
|---|---|---|---|
| 1604401 | 12/1981 | United Kingdom | 5/473 |

OTHER PUBLICATIONS

Brochure [EN-AB-1R (1988)] Uniroyal Plastics, 1988.

*Primary Examiner*—Alexander Grosz
*Attorney, Agent, or Firm*—Robert E. Massa

[57] ABSTRACT

A mattress of plastic foam material for medical purposes. The foam material is polyvinylchloride foam which has been coated with polyvinylchloride to create a completely seamless surface. Thus, the material is made impenetrable to potentially infectious body fluids which might be deposited thereon. In addition, the method of forming the entirely seamless surface prevents the accumulation of pathogenic fluids in various crevices which would otherwise be present in other types of seamless structures.

2 Claims, 2 Drawing Sheets

PVC MATTRESS WITH IMPERMEABLE PVC COATING

FIELD OF THE INVENTION

Our invention relates to a mattress. More particularly, our invention relates to a mattress of flexible foam material for use in health care. Still more particularly, out invention relates to a health care mattress which is seamless in order to prevent the absorption within the mattress of infectious or toxic fluids emanating from a patient lying thereon.

BACKGROUND OF THE INVENTION

The great advances in health care, particularly in the areas of patient comfort and general hygiene, have encouraged the attempts to develop comfortable mattress components which have an increased degree of sanitation.

Until rather recently, conventional health care mattresses had been constructed of natural material, such as cotton, and encased within a sheet of cotton material. The mattress was usually extremely hard and penetrable to fluids. Consequently, both comfort and hygiene were generally lacking.

With the development of foam rubber products, experimentation began with various types of foam rubber cores, but still with the predominant use of covers of cotton sheeting. Patient comfort was enhanced by the use of the various foam rubber products, and eventually by the further development of flexible plastic foam products, but there was still insufficient sanitation.

Mattresses with seams allow the invasion of pathogens which had been carried by the blood and other bodily fluids of the patient. Following invasion by way of the seam, it becomes impossible to perform complete decontamination. Therefore, subsequent patients or health care providers become gravely exposed to diseases such as AIDS (or the HIV virus), HBV (hepatitis B virus), and other fluid and bloodborne illnesses.

Even with mattress structures formed of foam rubber or foam plastic there had been no suitable sanitation because the mattresses still permitted the accumulation of contaminants by maintaining various forms of crevices, binding together incompletely of different layers of material, and particularly those structures which purposely have vent components for other purposes.

We have found out that the prior art discloses mattresses having the disadvantages we have described above: accessibility by contaminants by having loose covers, by having different layers which might become disconnected, and by having components exposed to ambient atmosphere.

The prior art we have found includes:

| | | |
|---|---|---|
| U.S. Pat. No. 3,058,124 | Sturtevant | Oct. 16, 1962 |
| U.S. Pat. No. 4,035,853 | Platter | July 19, 1977 |
| U.S. Pat. No. 4,275,473 | Poirier | June 30, 1981 |
| U.S. Pat. No. 4,316,298 | Russo et al | Feb. 23, 1982 |
| U.S. Pat. No. 4,357,725 | Ahim | Nov. 9, 1982 |
| U.S. Pat. No. 4,825,487 | Eberl | May 2, 1989 |
| U.S. Pat. No. 5,007,123 | Salyards | April 16, 1991 |

Brochure [EN-AB-1R(1988)] Uniroyal Plastics, 1988

U.S. Pat. No. 3,058,124 to Sturtevant describes a cushion of foam or sponge rubber disposed within a cover. The cover includes a tubular extension at one end to permit air to flow freely outwardly and inwardly of the cushion.

U.S. Pat. No. 4,035,853 to Platter describes a hospital mattress comprised of a plurality of layers of foamed material and a base of transverse support members. The support members comprise slats and dowels which are alternately arranged. The slats and dowels are maintained in alignment by nylon cords near each side of the mattress. The mattress also includes a removable bed pan plug.

U.S. Pat. No. 4,275,473 to Poirier describes a floating mattress comprising a plurality buoyant blocks, preferably of molded cellular polystyrene, arranged in side-by-side relation within an outer skin of a material which is capable of maintaining the orientation of the mattress, such as an outer skin of polyvinyl chloride film.

U.S. Pat. No. 4,316,298 to Russo describes a mattress assembly comprising a composite top pad and a lower pad. The top pad comprises two layers of foamed elastomeric material bonded to a mesh layer between them. The lower pad comprises a series of articulated sections of foamed elastomeric material of higher density than that of the top pad. Fabric tape handles extend between the upper layers with opposite ends extending beyond the mattress. Fastening means of readily detachable plastic components are attached between an upper position of the lower pad and lower position of top pad to cooperate and form a stabilizing means between the two pads.

U.S. Pat. No. 4,357,725 to Ahim describes a mattress comprising a thick inner core of resilient plastics material with predominantly open cells having a thin layer of resilient plastics material covering each of two longer side surfaces. Each of the two shorter side surfaces is left uncovered to allow the core to be exposed to the ambient air.

U.S. Pat. No. 4,825,487 to Eberl describes a mattress for new-born babies formed of a mat filled with easily deformable material. In addition, the mat may have a two-layered construction whereby one of the layers is harder than the other.

U.S. Pat. No. 5,007,123 to Salyards describes a flexible covering for a core of a mattress, such as a foam core, comprising flexible outer and inner coverings. The outer and inner coverings are made of materials of selected vapor transmission at prescribed temperatures and relative humidities.

The brochure of Uniroyal describes various closed-cell foam plastics and suggested uses for each.

SUMMARY OF THE INVENTION

The primary object of our invention is to provide a mattress which is light weight, flexible, and inexpensive.

Another object of our invention is to provide a health care mattress which will not absorb blood or other pathogenic fluids.

Still another object of our invention is to provide a health care mattress which is flexible for comfort, firm for support, and seamless for capability of being easily disinfected.

Still another object of our invention is to provide a health care mattress which is particularly advantageous for use in health care facilities where bloodborne or bodily fluid diseases are a major concern.

Another object of our invention is to provide a seamless health care mattress which possesses the capabilities of complete disinfection and which will withstand daily disinfecting for a long period of time.

Another object of our invention is to provide a health care mattress which is of such light weight that it can easily be lifted and carried by one person.

Still another object of our invention is to provide a health care mattress in various sizes suitable for use in ambulances, emergency rooms in hospitals, hospital beds and other health facilities.

In addition, another object of our invention is to provide a health care mattress which is easy to construct and sturdy.

We have had long experience in developing methods and providing services for the repair of plastic foam mats which are commonly used in athletic events such as gymnasium exercises and wrestling matches. Quite often these mats become slightly damaged by the treatment they receive. The most frequent damages consist of small tears or punctures which require repair immediately before the damage worsens.

The typical plastic foam athletic mat is made of polyvinylchloride closed-cell foam material without any added surface covering. Consequently, the foam material will have considerable water absorption, generally up to 0.1 lb/ft$^2$ of exposed surface. This type material alone, quite obviously, is not suitable for our purposes since we are requiring a seamless mattress which will not absorb water or bodily fluids.

We had developed a method for repairing small tears or punctures in the plastic foam mats by applying a thin polyvinyl film to the edges of the tears. The polyvinyl film polymerizes almost immediately and forms a strong, flexible seal between the edges of the tears.

Various closed-cell foam materials are manufactured and sold by Uniroyal Plastics Company under the trademark "ENSOLITE", primarily constituting polyvinylchloride/nitrite rubbers, "NEOPRENE", and other specialty polymers. Mattresses may be made of one sheet of these materials in thicknesses up to two inches.

Also, the individual sheets may be laminated to form thicker mattress of the same individual materials by using recommended adhesives of vinyl-nitrile foam.

The various closed-cell foam materials may be coated with a vinyl lacquer to increase weatherability, abrasion resistance, and toughness. However, a lacquer coating forms a hard, brittle surface which is unsuitable for our purposes.

Occasionally, plastic wrestling mats are coated with a baked-on coating known as "PLASTISOL XL" produced by Whittaker Corp. This coating provides a rather rough-textured finish which breaks somewhat more easily than a PVC surface and is more difficult to repair. Thus, this type surface is also rather unsuitable for our present purpose.

Based on our knowledge and experience in repairing wrestling mats, and improving upon that knowledge, we have expanded our methods of treatment to involve a coating of polyvinylchloride on a base component of flexible foam plastic material, covering all surfaces of that base component to form a seamless surface which is impenetrable to fluids.

Coatings may be applied in several different manners, as is indicated by the "ENSOLITE" brochure in the application of the lacquers: such as by brushing, roller coating, dipping, or spraying.

We have found that spraying a liquid film of polyvinylchloride will provide a slightly thicker coating, for example, from 0.005 inches thick to 0.025 inches thick, than is provided by dipping or brushing. The coating polymerizes almost immediately and forms a seamless surface which is flexible and durable.

Liquid polyvinylchloride is available in many colors, and may include fire retardants, or antistatic, or antibacterial additives.

In summary, we are providing a mattress for use in health services which comprises a thick base component of uniform construction of flexible foam plastic material having a thin flexible surface coating of polyvinylchloride which forms a seamless surface on all sides of the base component so that the mattress is impenetrable to any fluids deposited thereon.

DESCRIPTION OF THE PREFERRED EMBODIMENTS

Figure 1:
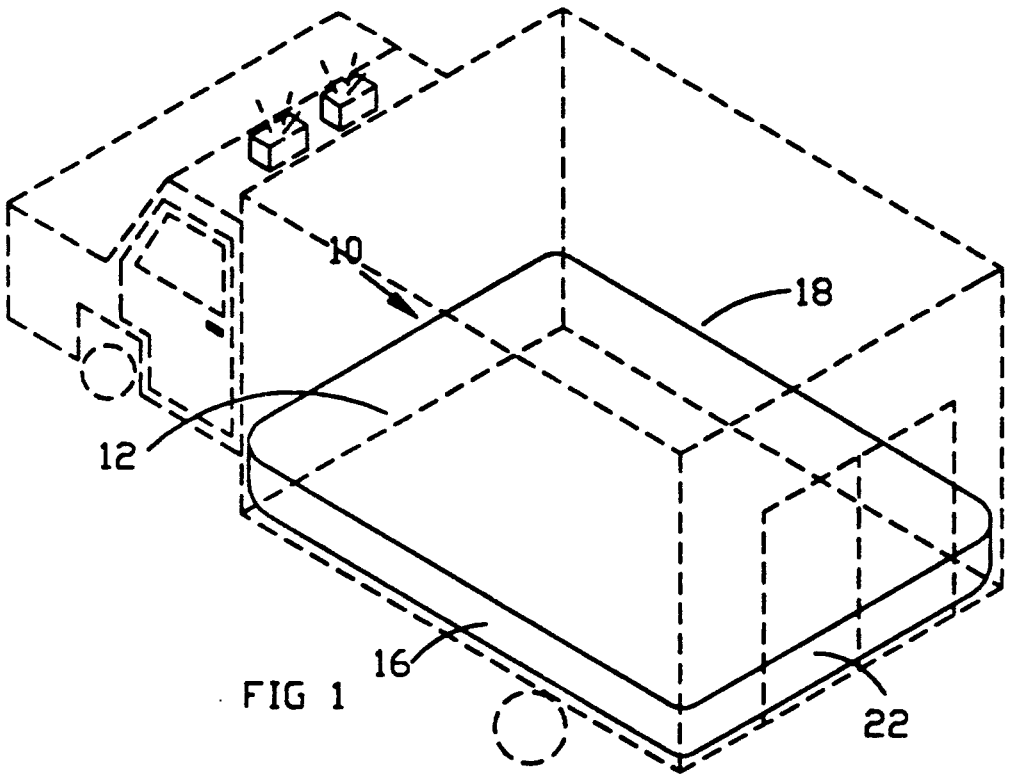
FIG. 1 describes a health service mattress according to our invention as it would be positioned for use within a health service vehicle with the health service vehicle shown in phantom.

FIG. 1 describes a health service mattress 10, generally, according to our invention which we show in one typical use, as in this instance, within an ambulance. A health service mattress according to our invention may easily be placed within an ambulance because of the flexibility of the mattress. The mattress may be positioned with ease by one person, and may be easily removed from within an ambulance by one person. As we emphasized above, we construct the mattresses to be seamless and to be impenetrable to bloodborne or bodily fluids.

Our mattress comprises a top 12, bottom 14, sides 16 and 18, and ends 20 and 22. For further comfort and ease in handling, we prefer that all surfaces should join adjacent surfaces with smooth curvatures as we have shown in all the figures.

Figure 2:
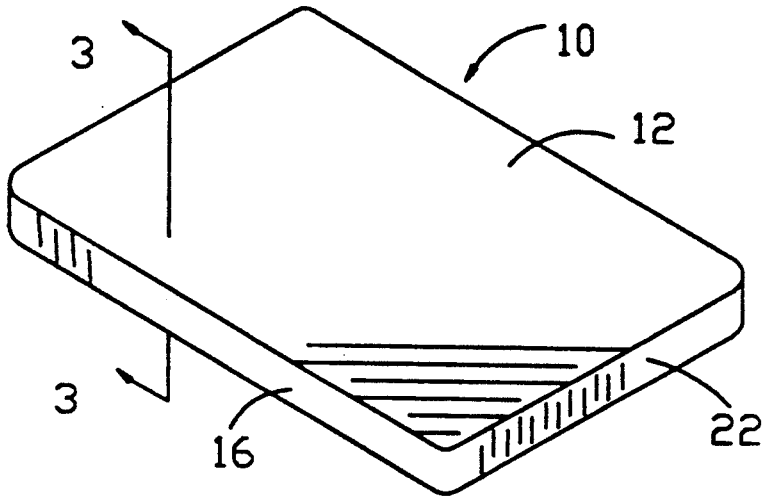
FIG. 2 is an isometric view of a health service mattress according to our invention.

FIG. 2 is a perspective view of a mattress 10, according to our invention, as it would be adaptable for handling for positioning upon any other type of health service device, such as a hospital bed, hospital cart, or other health care convenience.

Figure 3:
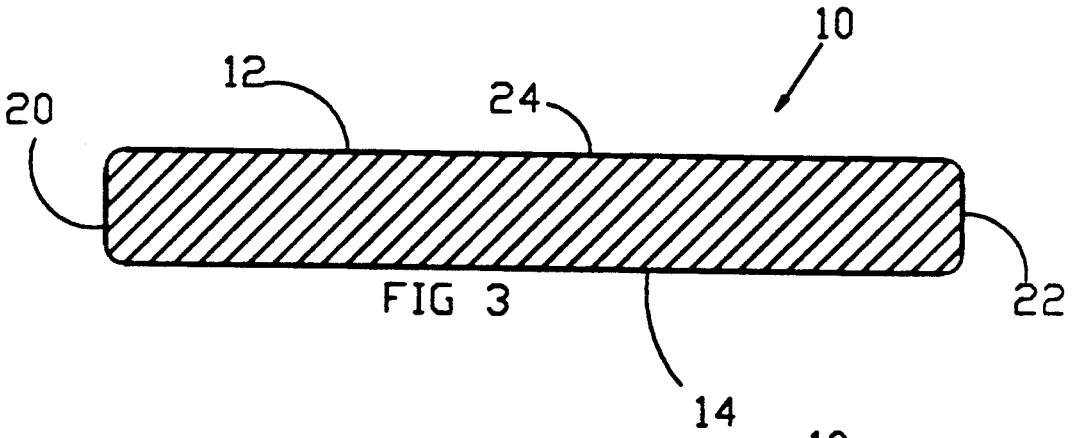
FIG. 3 is a cross sectional view of a health service mattress according to our invention along the lines 3—3 of FIG. 2.

FIG. 3 is a cross-sectional view along the lines 2—2 of FIG. 2 depicting the structure and inner material of the mattress 10. As we described above, we are using a base component of closed-cell foam, polyvinylchloride material with a coating 24 of polyvinylchloride applied smoothly and evenly to all surfaces, as we had described, in a preferred thickness of from 0.0005 inches thick to 0.025 inches thick.

Figure 4:
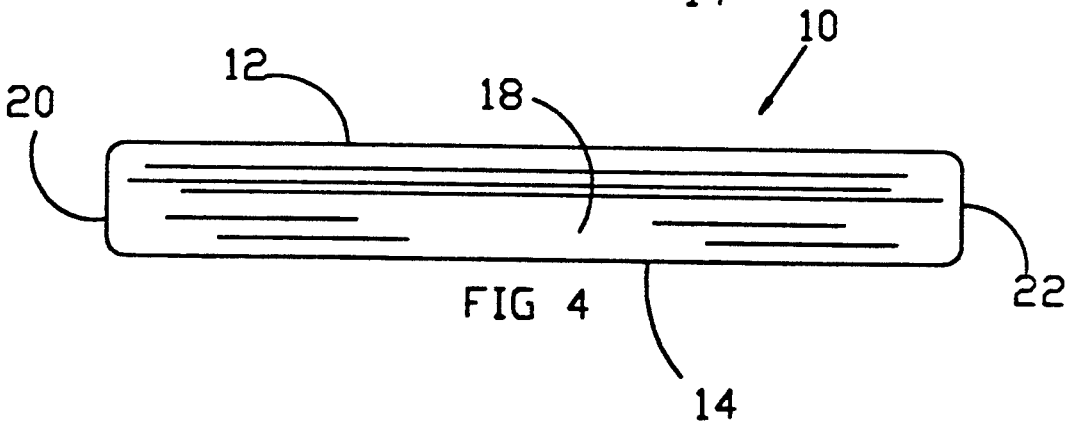
FIG. 4 is a side elevational view of a health service mattress according to our invention.

FIG. 4 is a side elevational view of a mattress according to our invention describing particularly the curved edges of our mattresses which we believe enhance the comfort of the patient.

Since many different embodiments of our invention may be made without departing from the spirit and scope thereof, it is to be understood that the specific embodiments described in detail herein are not to be taken in a limiting sense, since the scope of the invention is best defined by the appended claims.

We claim:

1. A mattress for use in health services comprising:

a thick base component of uniform rectangular construction formed of closed-cell polyvinylchloride foam plastic material, said base component having a thin flexible surface coating of polyvinylchloride applied smoothly and evenly to all surfaces of the base component forming a seamless surface on all sides of the base component so that the mattress is impenetrable to fluids deposited thereon.

2. A mattress for use in health services as described in claim 1 wherein:

the polyvinylchloride surface coating is between 0.005 and 0.025 inches thick.

* * * * *